US009504302B2

(12) United States Patent
Yu

(10) Patent No.: US 9,504,302 B2
(45) Date of Patent: Nov. 29, 2016

(54) HAIR STYLING DEVICE

(71) Applicant: KONINKLIJKE PHILIPS N.V., Eindhoven (NL)

(72) Inventor: Wai Kong Yu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/434,128

(22) PCT Filed: Jul. 4, 2014

(86) PCT No.: PCT/IB2014/062852

§ 371 (c)(1),
(2) Date: Apr. 8, 2015

(87) PCT Pub. No.: WO2015/011588

PCT Pub. Date: Jan. 29, 2015

(65) Prior Publication Data

US 2016/0120283 A1 May 5, 2016

(30) Foreign Application Priority Data

Jul. 24, 2013 (EP) ..... 13177743

(51) Int. Cl.

| | |
|---|---|
| ***A45D 1/00*** | (2006.01) |
| ***A45D 2/40*** | (2006.01) |
| ***A45D 2/00*** | (2006.01) |
| ***A45D 1/06*** | (2006.01) |
| ***A45D 1/14*** | (2006.01) |
| ***A45D 19/16*** | (2006.01) |
| *A45D 1/04* | (2006.01) |

(52) U.S. Cl.

CPC ..... *A45D 2/001* (2013.01); *A45D 1/06* (2013.01); *A45D 1/14* (2013.01); *A45D 19/16* (2013.01); *A45D 1/04* (2013.01)

(58) Field of Classification Search

CPC ..... A45D 1/00; A45D 1/06; A45D 1/04; A45D 1/08; A45D 1/10; A45D 1/12; A45D 1/14; A45D 1/16; A45D 1/28; A45D 2/001; A45D 2/40

See application file for complete search history.

(56) References Cited

U.S. PATENT DOCUMENTS

| | | | | |
|---|---|---|---|---|
| 6,278,086 | B1 | 8/2001 | Janouch | |
| 7,445,012 | B2 * | 11/2008 | Mukai | A45D 1/04 132/224 |
| 8,091,563 | B2 * | 1/2012 | Shepherd | A45D 1/04 132/224 |
| 8,418,699 | B2 | 4/2013 | Kim | |
| 8,789,539 | B2 * | 7/2014 | Linglin | A45D 1/04 132/224 |
| 8,888,739 | B2 * | 11/2014 | Gregory | A61M 25/10187 604/99.01 |
| 9,173,466 | B2 * | 11/2015 | Rivola | A45D 2/367 |

(Continued)

FOREIGN PATENT DOCUMENTS

| | | | |
|---|---|---|---|
| EP | 1894487 | A1 | 3/2008 |
| JP | 2011024674 | A | 2/2011 |
| WO | 2008030064 | A1 | 3/2008 |

*Primary Examiner* — Robyn Doan

(57) ABSTRACT

A hair styling device comprising two jaws, at least one jaw (1) of which having a resiliently mounted heating plate (16) that is allowed to move in such a way, that when the hair styling device is fully closed, both a first maximal gap at a proximal end of the heating plate (16) between the heating plate (16) and a mating element of the other jaw in the absence of a detachable holder (5) with a hair treatment agent, and a second maximal gap at the proximal end of the heating plate (16) between the detachable holder (5) and the mating element of the other jaw in the presence of the detachable holder (5), are within a range of about 1 mm-1.5 mm.

3 Claims, 3 Drawing Sheets

(56) References Cited

U.S. PATENT DOCUMENTS

2002/0036000 A1* 3/2002 Hirata ..... A45D 1/00
132/224
2007/0240731 A1 10/2007 Mukai
2009/0188516 A1 7/2009 Catini
2012/0017932 A1 1/2012 Takehana

* cited by examiner

HAIR STYLING DEVICE

This application is the U.S. National Phase application under 35 U.S.C. §371 of International Application No. PCT/IB2014/062852, filed on Jul. 4, 2014, which claims the benefit of European Application No. 13177743.5 filed on Jul. 24, 2013. These applications are hereby incorporated by reference herein.

FIELD OF THE INVENTION

The invention relates to a hair styling device.

BACKGROUND OF THE INVENTION

EP 1 030 571 discloses a hair forming appliance with a handle portion, a heating portion for heating the hair, and a clamping member adapted to be moved into an open and a closed state, with the hair being insertable between the heating portion and the clamping member, in which provision is made for a pressing member arranged between the heating portion and the clamping member for exerting a pressure on the hair, and the pressing member is resiliently mounted on the hair forming appliance. The pressing member is carried by two springs arranged in particular at opposite ends of the pressing member such as to produce a spring force in a radial direction.

US 2012/0017932 discloses a hair styling device having a detachable holder with a hair treatment agent. The hair styling device has two arms facing each other. The hair treatment agent-holder impregnated with the hair treatment agent or holding the hair treatment agent is detachably attached to one arm or to both arms. A heating means is provided in a device main body and/or one arm or both arms.

SUMMARY OF THE INVENTION

It is, inter alia, an object of the invention to provide an improved hair styling device having a resiliently mounted heating plate, and a detachable holder with a hair treatment agent. The invention is defined by the independent claims. An advantageous embodiment is defined in the dependent claims.

In a hair straightener with resiliently mounted heating plates, when the two jaws (or arms) are fully closed, the distal ends of the heating plates will touch while the proximal ends will reserve a gap as at their proximal ends, the heating plates can still move as a result of their being resiliently mounted. The notions "distal" and "proximal" are to be understood as viewed from a hinge of the hair straightener. The maximum width of the gap at the proximal ends of the heating plates in this fully closed situation is preferably within a range of 1 mm-1.5 mm to obtain good gliding results and to have a sufficiently tight clamping of the hair.

Without the present invention, when detachable holders with a hair treatment agent (e.g. sleeves) are mounted onto the heating plates, when the hair styling device is fully closed, the maximum gap between the heating plates at their proximal ends in the absence of sleeves differs from the maximum gap between the sleeves in the situation that sleeves are mounted onto the heating plates. If either one of the "no sleeve situation" or "with sleeve situation" is designed to fulfill the desired design requirement that the width of the gap is preferably within a range of 1 mm-1.5 mm, the other situation will not meet that desired design requirement. For example, if the "with sleeve situation" is designed such that the desired design requirement is fulfilled, such that the rear gap is e.g. 1 mm in closed position, then the rear gap in the "no sleeve situation" will become 2.4 mm, which causes a poor gliding result.

One embodiment of the present invention provides a mechanism which controls the proximal end of the floating heat plate with less travel during "no sleeve situation", such that the proximal gap can maintain 1 mm which fulfills the preferred width of 1 mm-1.5 mm.

An aspect of the present invention provides a hair styling device comprising two jaws, at least one jaw of which having a resiliently mounted heating plate that is allowed to move in such a way, that when the hair styling device is fully closed, both a first maximal gap at a proximal end of the heating plate between the heating plate and a mating element of the other jaw in the absence of a detachable holder with a hair treatment agent, and a second maximal gap at the proximal end of the heating plate between the detachable holder and the mating element of the other jaw in the presence of the detachable holder, are within a range of about 1 mm-1.5 mm.

For example, while in one embodiment of the present invention, the hair styling device has two jaws each having a heating plate onto which a detachable holder may be mounted (like in FIG. 5 of US2012/0017932 their detachable holder is mounted on both jaws), in another embodiment such a detachable holder is only mounted onto one of the heating plates (like in FIG. 4A of US2012/0017932 their detachable holder is only mounted onto one jaw). So, in the claims, the mating element of the other jaw may be another heating plate, or another detachable holder mounted onto the other heating plate, depending on whether the embodiment allows the detachable holder to be mounted onto only one or onto both heating plates, and in case detachable holders can be mounted onto both heating plates, how a user uses the hair styling device (as a user may decide to mount only one detachable holder even if detachable holders can be mounted onto both jaws).

These and other aspects of the invention will be apparent from and elucidated with reference to the embodiments described hereinafter.

DESCRIPTION OF EMBODIMENTS

Figure 1:
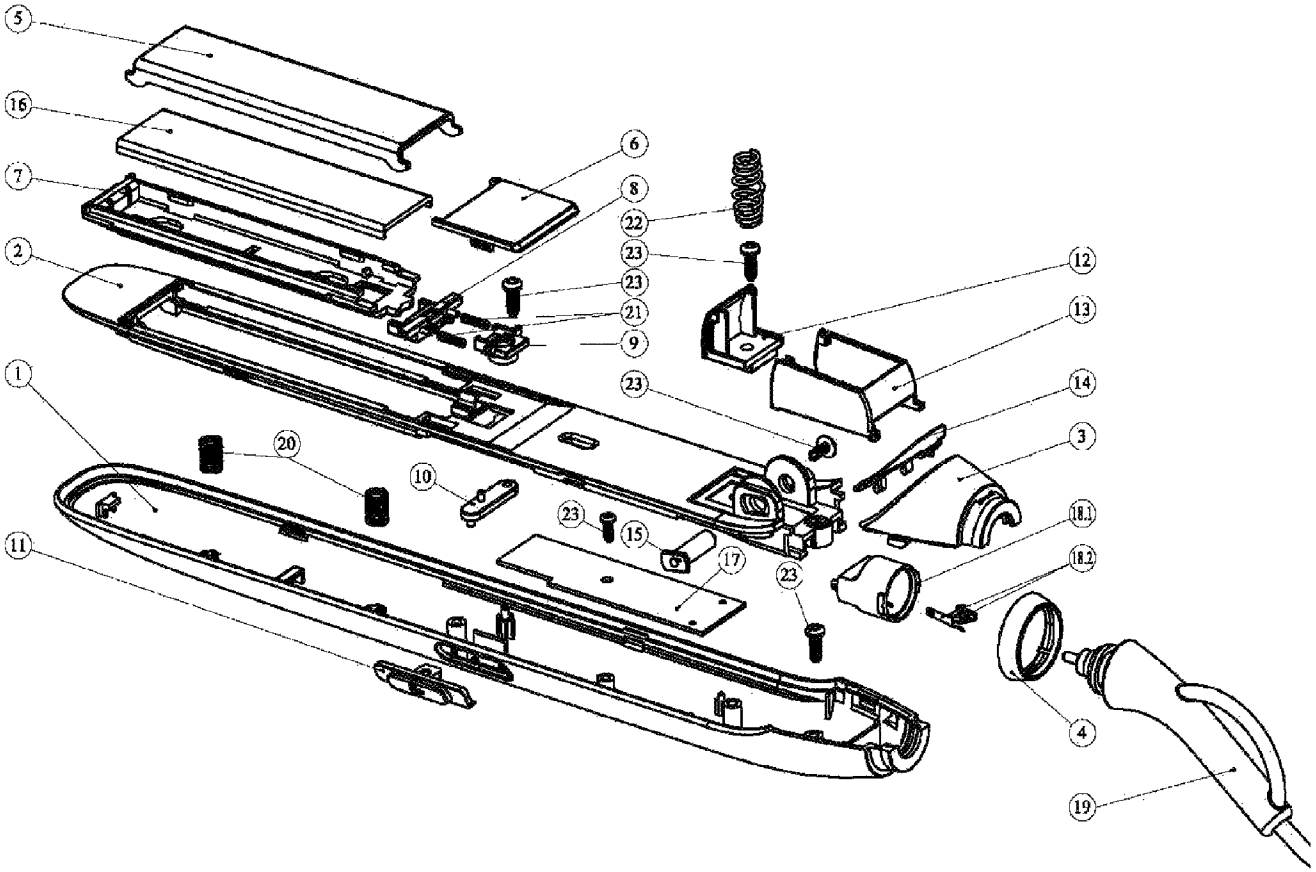
FIG. 1 shows an exploded view of a lower jaw of a hair styling device in accordance with an embodiment of the present invention.

In the exploded view of FIG. 1, the reference signs have the following meanings:

1 housing, lower part
2 inner housing cover, lower part
3 end cover
4 lock ring
5 detachable holder with a hair treatment agent, in this embodiment a sleeve
6 sleeve sliding cover

7 heat resistant frame
8 unit capable of engaging the detachable holder 5, in this embodiment a sleeve release bracket
9 fixing plate
10 lower lever
11 lower sleeve switch cover
12, 13 hinge cover parts
14 decoration plate
15 shaft
16 heating plate
17 printed circuit board assembly
18.1, 18.2 swivel contact plate
19 power cord
20, 21, 22 springs
23 tapping screws.

As shown in FIG. 1, the straightener has an extended function wherein an accessory, a sleeve 5, can be attached to the heating plate 16. The sleeve 5 contains active ingredients that will be released to the hair during the straightening of hair.

Figure 2A:
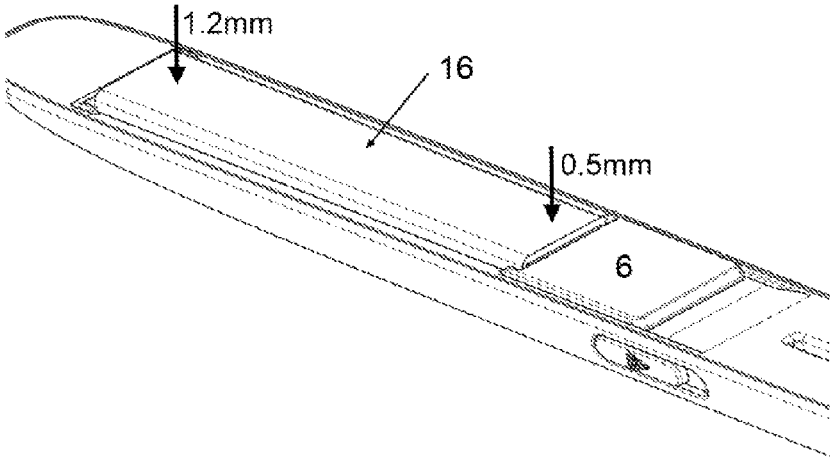
FIGS. 2A, 2B show part of the lower jaw of the hair styling device in accordance with the embodiment of the present invention, in the situation that no sleeve is mounted.
Figure 2B:
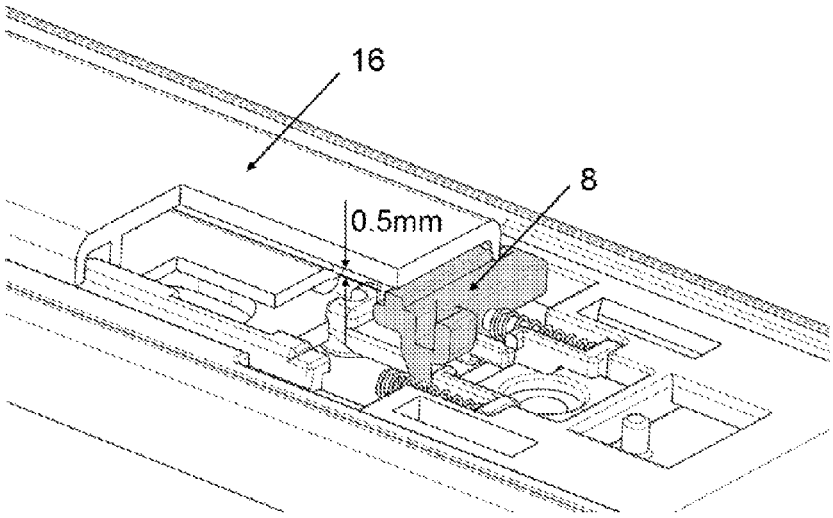

FIGS. 2A, 2B show part of the lower jaw of the hair styling device in accordance with the embodiment of the present invention, in the situation that no sleeve is mounted. As a result of the fact that the heating plate 16 is resiliently mounted by means of the springs 20 shown in FIG. 1, the heating plate 16 "floats" on these springs 20, and can move down by 1.2 mm at a distal end, and by 0.5 mm at a proximal end. Underneath the heating plate 16, at the proximal end, there is a sleeve release bracket 8, which also acts as a stopper limiting the downward movement of the heating plate 16 at the proximal end. The space between the stopper part 8*a* (see FIG. 3A) of sleeve release bracket 8 and the heating plate 16 is 0.5 mm, which limits the movement of the proximal part of the heating plate 16 to 0.5 mm. As a result of the difference between the freedom of movement at the distal end (1.2 mm) and at the proximal end (0.5 mm) in the absence of a sleeve, it is ensured that if the hair styling device is fully closed, i.e. fully consuming the 1.2 mm at the distal end, at the proximal end the gap is maximally 2×0.5 mm (i.e. 0.5 mm at each jaw), so that hair can be sufficiently tightly clamped between the two jaws of the hair styling device.

Figure 3A:
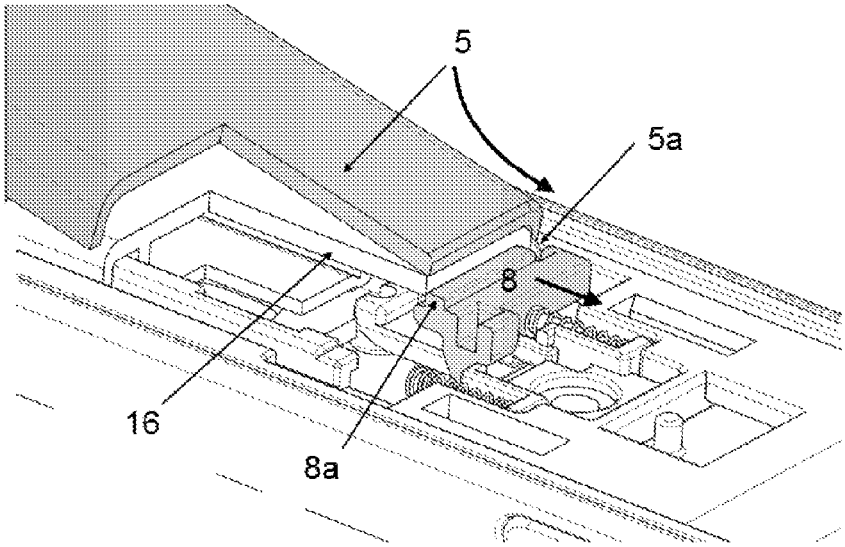
FIGS. 3A, 3B show part of the lower jaw of the hair styling device in accordance with the embodiment of the present invention, in the situation that a sleeve is mounted.
Figure 3B:
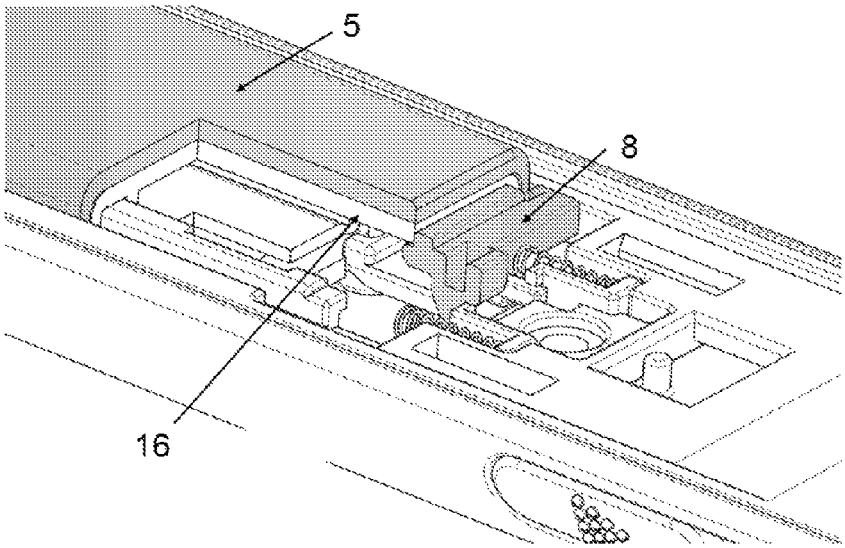

FIGS. 3A, 3B show part of the lower jaw of the hair styling device in accordance with the embodiment of the present invention, in the situation that the sleeve 5 is mounted. When the sleeve 5 is installed, catches 5*a* of the sleeve 5 push the sleeve release bracket 8 backward, so that the stopper part 8*a* moves away from the heating plate 16, and the heating plate 16 can move down by 1.2 mm, limited by a rim of the sleeve release bracket 8. In the mounted situation shown in FIG. 3B, the sleeve 5 stacks on the heating plate 16. The springs 21 (see FIG. 1) ensure that the sleeve release bracket 8 is shifted back by e.g. 1 mm so as to hold the sleeve 5 in position. So, when the sleeve is mounted, the heating plate 16 can move down by 1.2 mm both at the distal end and at the proximal end. In this situation, with the sleeve 5 mounted on top of the heating plate 16, with the sleeve 5 having a thickness of e.g. 1.5 mm, it is again ensured that if the hair styling device is fully closed, i.e. fully consuming the 1.2 mm at the distal end, at the proximal end the gap is maximally 2×0.5 mm (i.e. 0.5 mm at each jaw), so that hair can be sufficiently tightly clamped between the two jaws of the hair styling device. So, the 1.2 mm maximal downward movement in the presence of the sleeve 5 does not need to fully compensate for the thickness of the sleeve 5, which may be e.g. 1.5 mm.

It should be noted that the above-mentioned embodiments illustrate rather than limit the invention, and that those skilled in the art will be able to design many alternative embodiments without departing from the scope of the appended claims. Any dimensions mentioned in this description are just examples. While in the above embodiment, the maximum gap in the absence of the sleeves happens to be the same as the maximum gap in the presence of the sleeves, what matters is that both maximum gaps are within a range of about 1 mm-1.5 mm. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements.

The invention claimed is:

1. A hair styling device comprising two jaws, wherein at least one jaw includes a resiliently mounted heating plate, wherein the resiliently mounted heating plate is mounted in a housing with a freedom of movement configuration having a stopper limiting movement of the resiliently mounted heating plate that comprises one of (i) a first maximal gap stop setting and (ii) a second maximal gap stop setting, different from the first maximal gap stop setting, at a proximal end of the heating plate when the hair styling device is fully closed, wherein responsive to an absence of a detachable holder with hair treatment agent or sleeve being mounted with the resiliently mounted heating plate, the stopper limiting movement includes the first maximal gap stop setting that limits a freedom of movement of the resiliently mounted heating plate to a first maximal gap at a proximal end of the heating plate between (i) the heating plate and (ii) a mating element of the other jaw, and wherein responsive to a presence of a detachable holder with hair treatment agent or sleeve being mounted with the resiliently mounted heating plate, the stopper limiting movement includes the second maximal gap stop setting that limits a freedom of movement of the resiliently mounted heating plate to a second maximal gap at the proximal end of the heating plate between (i) the detachable holder or sleeve and (ii) the mating element of the other jaw, wherein the first and second maximal gap are each maintained within a range of 1 mm-1.5 mm.

2. The hair styling device as claimed in claim 1, further comprising a unit configured for being engaged by a sleeve catch of the detachable holder or sleeve, wherein the unit comprises a stopper part that is arranged for limiting movement of the resiliently mounted heating plate (i) to the second maximal gap stop setting in the presence of the detachable holder or sleeve engaging the unit and (ii) to the first maximal gap stop setting in the absence of the detachable holder or sleeve engaging the unit.

3. The hair styling device as claimed in claim 2, wherein the detachable holder or sleeve includes the sleeve catch that is configured for engaging the unit in response to the detachable holder or sleeve being mounted with the resiliently mounted heating plate, wherein mounting the detachable holder or sleeve results in a shift of the stopper part of the unit by engagement of the sleeve catch with the unit such that the stopper part is moved from a position of the first maximal gap stop setting to a position of the second maximal gap stop setting.

* * * * *